United States Patent [19]

Thow et al.

[11] Patent Number: 4,971,030

[45] **Date of Patent: * Nov. 20, 1990**

[54] GAS-FIRED ARTIFICIAL LOG STOVE ASSEMBLY

[75] Inventors: Ian Thow, St. Helens, England; Ajay K. Gupta, Cincinnati, Ohio

[73] Assignee: Yale and Valor p.l.c., London, England

[ * ] Notice: The portion of the term of this patent subsequent to Nov. 28, 2006 has been disclaimed.

[21] Appl. No.: 442,070

[22] Filed: Nov. 28, 1989

Related U.S. Application Data

[63] Continuation-in-part of Ser. No. 290,294, Dec. 27, 1988, Pat. No. 4,883,043.

[51] Int. Cl.[5] ..... F24C 3/00

[52] U.S. Cl. ..... 126/512; 126/92 AC; 126/523; 126/531; 431/125

[58] Field of Search ..... 126/512, 503, 528, 500, 126/90 R, 92 AC, 531, 92 B, 523; 431/125, 110, 112, 328, 329; 40/428

[56] References Cited

U.S. PATENT DOCUMENTS

| | | | |
|---|---|---|---|
| 1,017,751 | 2/1912 | Hansen | 431/125 |
| 1,603,109 | 5/1927 | Chandler | 431/125 |
| 2,671,440 | 3/1954 | Dupler | 126/512 |
| 3,042,109 | 7/1962 | Peterson | 431/125 |
| 3,277,882 | 10/1966 | Rose | 126/512 |
| 3,696,801 | 10/1972 | Whitehead | 431/125 |
| 3,760,790 | 9/1973 | Voges et al. | 431/125 |
| 4,258,693 | 3/1981 | Baker | 126/67 |
| 4,271,815 | 6/1981 | Johnson | 126/517 |
| 4,542,735 | 9/1985 | Smith et al. | 126/92 AC |
| 4,573,446 | 3/1986 | Rosiek et al. | 126/92 R |
| 4,573,905 | 3/1986 | Meyers | 126/512 |
| 4,602,609 | 7/1986 | Wright | 126/92 AC |
| 4,668,545 | 8/1987 | Patterson | 126/77 |
| 4,726,351 | 2/1988 | Whitaker et al. | 431/125 |
| 4,793,322 | 12/1988 | Shimek et al. | 126/512 |
| 4,828,485 | 5/1989 | Jankowski | 431/125 |
| 4,883,043 | 11/1989 | Thow et al. | 431/125 |

FOREIGN PATENT DOCUMENTS

| | | |
|---|---|---|
| 532097 | 1/1941 | United Kingdom . |
| 2133530 | 1/1983 | United Kingdom . |
| 2135047 | 8/1984 | United Kingdom . |
| 2169700 | 7/1986 | United Kingdom . |
| 2177490 | 1/1987 | United Kingdom . |
| 2185100 | 7/1987 | United Kingdom . |
| 2193569 | 2/1988 | United Kingdom . |

*Primary Examiner*—James C. Yeung
*Attorney, Agent, or Firm*—Wood, Herron & Evans

[57] ABSTRACT

The present invention relates to a gas-fired artificial log stove assembly, and more particularly to a gas stove assembly which visually simulates, in a realistic fashion, a traditional fire in a gas-fired stove stacked with horizontally disposed artificial logs, and which at the same time supplies substantial space heat to the surrounding room environment by heating room air circulated through a heat exchange mechanism.

5 Claims, 5 Drawing Sheets

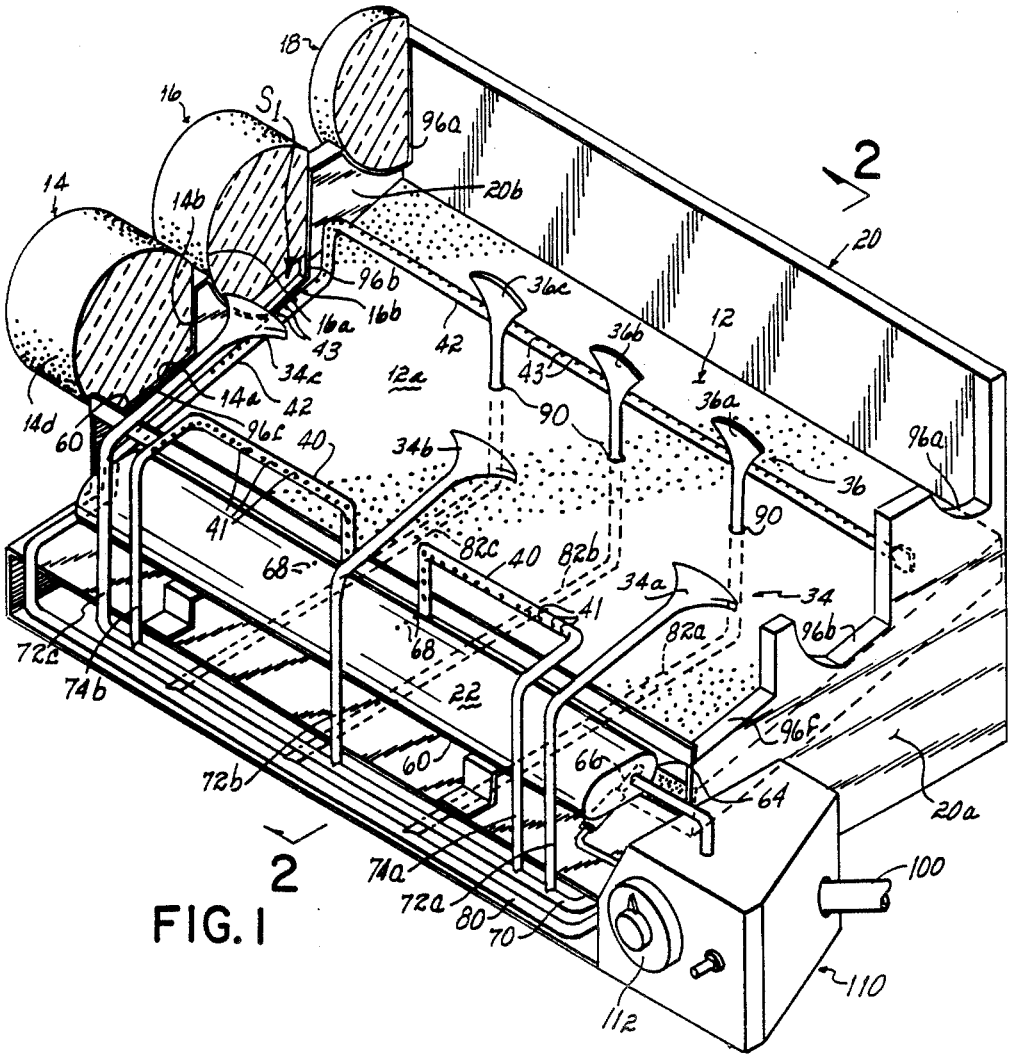
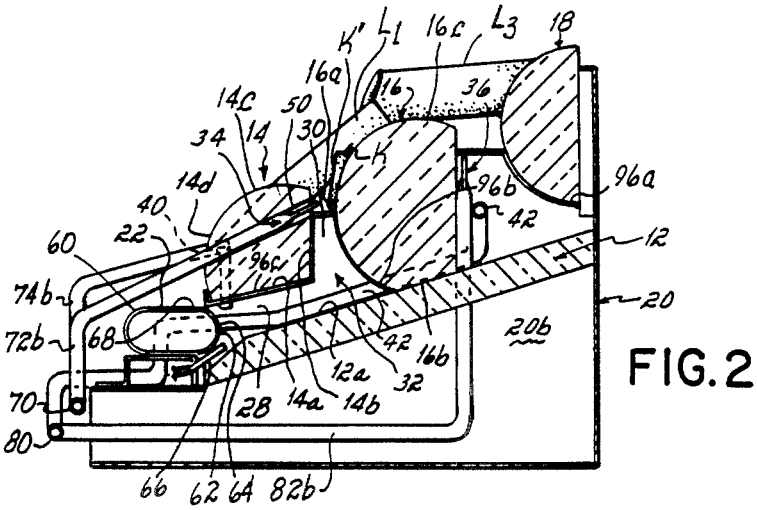
FIG. 2

GAS-FIRED ARTIFICIAL LOG STOVE ASSEMBLY

This application is a continuation-in-part of U.S. patent application Ser. No. 07/290,294, filed on Dec. 27, 1988, which issued as U.S. Pat. No. 4,883,043, on Nov. 28, 1989.

FIELD OF THE INVENTION

The present invention relates to a gas-fired artificial log stove assembly, and more particularly to a gas stove assembly which visually simulates, in a realistic fashion, a fire in a gas-fired stove stacked with horizontally disposed artificial logs, and which at the same time supplies substantial heat to the surrounding room environment by heating room air circulated through a heat exchange mechanism.

BACKGROUND OF THE INVENTION

Fuel burning fireplaces and stoves are very popular and desirable in houses and apartments, both for heating as well as for aesthetics. There are two primary types of fuel burning fireplaces and stoves—those in which solid fuels such as wood, coal, coke, peat or combinations thereof are burned, and those which burn gas and have simulated solid fuel elements, such as artificial logs, to add an element of realism. Gas fires in stoves and fireplaces have the advantage that they do not require manual refueling or clearing of ashes and they are very controllable. Because of the advantages of gas fires, considerable efforts have been made to recreate the appearance of traditional solid fuel fires.

Simulated solid fuel gas fires for fireplaces, that is, those having artificial solid fuel elements such as logs, are known. In general, these consist of a simulated fuel bed which is heated to incandescence by flames, or by the products of combustion of flames, to simulate the visible glowing embers of a solid fuel fire. A principal feature in the aesthetic appeal of real, or traditional, solid fuel fires is the existence of visually perceptible, luminous flames flickering about the main fuel bed. Such flames can be closely mimicked in simulated solid fuel gas fires by burning neat gas, i.e., gas with little or no primary aeration, which produces a yellow flame. Simulated solid fuel gas fires which incorporate this feature in combination with an incandescent or glowing bed are known. Such neat gas flames, like those produced in real or traditional solid fuel fires, are not static or spatially fixed, but move or waver about irregularly or randomly due to the airflow in the fireplace.

U.S. Pat. No. 4,602,609, discloses a simulated solid fuel fireplace having a main heater burner and a plurality of flame effect burners. The flame effect burners burn neat gas (non-aerated) to produce yellow flames, while the heater burner burns a gas-air mixture with a higher air content to produce very hot "blue" flames for space heating purposes. U.S. Pat. No. 4,573,446 also discloses a simulated solid fuel fire which has a neat gas burner for producing visible yellow flames and a main burner for producing blue heat flames.

There is generally incomplete combustion of the neat gas burned in neat gas burners due to the low air-to-gas ratio in the burners. As a result of the incomplete combustion, carbon monoxide and soot are produced as by-products of the flames. For safety reasons, it is desirable to minimize the production of carbon monoxide and soot.

Fuel burning stoves having heat exchangers for heating room air are also known. See, e.g., U.S. Pat. Nos. 4,258,693 and 4,688,545, which are directed to solid fuel (such as wood) burning stoves having a combustion chamber and an air space through which room air is circulated to be heated prior to discharge into the adjacent room. These devices have the drawbacks associated with solid fuel burning fireplaces, i.e., manual refueling, clearing of ashes, lack of direct control over the flames. UK Patent Application Nos. 2,193,569A and 2,177,490A disclose simulated solid fuel gas fires with heat exchange mechanisms for heating ambient air in the adjacent rooms. These devices, which use simulated solid fuel, do not provide aesthetically pleasing, realistic flame fires.

The known gas fireplace and stove assemblies, including those featuring horizontally stacked artificial logs, are generally lacking in either the aesthetics of real flame fires or in heat production, or both, as well as having the drawback of producing undesirable by-products due to the incomplete combustion of neat gas. The present invention addresses the shortcomings of the prior art by providing a very realistic-looking simulated gas fire in a stove assembly having horizontally stacked artificial logs which provides substantial heat to the surroundings through a heat exchange mechanism and which produces minimal undesirable combustion by-products.

SUMMARY OF INVENTION

A preferred embodiment of the gas fireplace assembly of this invention includes a suitably supported base plate of a refractory material that glows visibly when heated above approximately 1472° F. A first or front artificial log of refractory material is supported in spaced relation above the base plate to define therewith a first elongated generally horizontally disposed chamber section. A second artificial log of refractory material is supported proximal the base plate and spaced rearwardly from the front log to define a second elongated generally vertically disposed chamber section. Both logs are disposed generally horizontally and parallel to each other and to the plane of the opening of the fireplace in which the assembly is disposed, such that the first and second chamber sections cooperate to collectively define an elongated heat chamber having an L-shaped or angled cross section which spans the width of the fireplace.

The preferred embodiment of the fireplace assembly further includes an elongated heater burner extending horizontally forward of and parallel to the front log for directing "blue" flame jets generally rearwardly into the elongated heat chamber. The flames issuing from the heater burner heat to a visible glow, which is at least approximately 1470° F., the bottom and rear surfaces of the front log, and the front surface of the second log. In this way, the aesthetics of red-glowing horizontal logs and underlying embers is simulated while at the same time substantial heat is radiated to the surroundings. The upper surface of the base plate preferably is highly textured to maximize its resemblance to burning embers when appropriately heated. In a preferred form of the invention, both the base plate and the horizontally arranged artificial logs are made of an inorganic alumina silicate (ceramic) fiber material which permits them to be heated to temperatures of approximately 2370° F. or more, thereby further enhancing the heat radiating and aesthetic qualities of the fireplace.

In another preferred form of the invention, the artificial logs may be composite logs of the type disclosed in co-pending U.S. patent application Ser. No. 443,109, filed Nov. 28, 1989, in the name of Ian Thow, entitled COMPOSITE ARTIFICIAL LOG the specification of which is hereby incorporated herein by reference. These composite logs have a ceramic concrete section molded to resemble a real log and a relatively high thermal conductivity which radiates a substantial amount of heat to the surroundings when heated, and a ceramic fiber section having a relatively low thermal conductivity which glows visibly when heated above about 1470° F. The ceramic concrete and ceramic fiber sections may be secured together with a suitable adhesive, mechanical fasteners or by interfitting and mating with one another.

The preferred horizontal log fireplace assembly also includes a first set of neat gas burners which pass through the front log and emerge from the rear surface thereof for issuing yellow neat gas flame jets upwardly and rearwardly toward the front surface of the second log. The flames issuing from the first set of neat gas burners impinge on the front surface of the second log in a generally tangential direction at the approximate midpoint of the front surface thereof. These flames are visible and give the appearance of burning logs, thereby enhancing the realism and visual aesthetics of the fireplace assembly. The elongated heat chamber defined by the base plate and the front and second logs retains the heat produced by the main burner flame so as to increase the combustion efficiency of the gas issuing from the first set of neat gas burners, thereby reducing the undesirable combustion by-products such as carbon monoxide and soot. The hot gases in the heat chamber causes turbulence, which in turn causes the yellow flames issuing from the first set of neat gas burners to flicker. The glowing base plate and logs and the flickering yellow flames add aesthetic appeal to the horizontal log fireplace assembly of this invention.

The fireplace assembly, in accordance with certain further principles of the invention, further includes two elongated horizontally disposed front burners located proximate the front surface of the front log, preferably embedded in it. These burners cause the front surface of the front log to visibly glow, and thereby enhance the aesthetics and realism of the artificial log fireplace assembly.

In addition, the fireplace assembly may further comprise a third log of refractory material or a composite log disposed generally horizontally and parallel to the front and second logs, and supported such that it is spaced rearwardly of the second log. Preferably, the base plate is inclined upwardly and rearwardly such that the top of the third log is positioned above the top of the second log, which is in turn positioned above the top of the front log, thus rendering all three logs visible from in front of the fireplace assembly. In a preferred embodiment, there is also included a second neat gas burner disposed between the second and third logs for issuing yellow-color flame jets in a generally upward direction, thereby further enhancing the realism of the horizontally stacked artificial log fireplace.

In an alternative preferred embodiment, the present invention is directed to a gas-fired artificial log stove assembly comprising an artificial log assembly having three logs, substantially as described hereinabove with respect to the fireplace assembly, disposed in the combustion chamber of a gas-fired stove to provide an aesthetically pleasing, realistic-looking gas fire. The stove assembly additionally includes an air chamber having a heat exchange mechanism, which air chamber partially or substantially surrounds the combustion chamber and through which room air is circulated for heating prior to discharge into the adjacent room. The hot combustion by-products of the gas fire are circulated through the heat exchanger on the hot side, prior to discharge from the stove assembly through a flue, to heat the circulating room air.

It has been advantageously determined that certain modifications to the log assembly described hereinabove, together with certain features of the stove housing the log assembly, provide a stove assembly which is well suited to produce a realistic-looking fire and at the same time provide substantial heat to the surroundings.

In a preferred embodiment of the stove assembly of the present invention, the log assembly is disposed in a combustion chamber having sheet steel walls, or any other suitable material that can withstand the high operating temperatures of the stove, on the top, bottom, rear and sides. The front opening of the combustion chamber preferably has glass doors that can be closed securely to seal the combustion chamber, thereby preventing the escape of combustion by-products into the adjacent room environment. The rear wall of the combustion chamber has an aperture therein through which the combustion by-products pass into the heat exchanger and out through the flue. The front wall of the stove housing, below the glass doors, has a plurality of grate-covered combustion air openings through which room air is drawn into the combustion chamber, due to natural convection when the stove is in operation to provide air for combustion. Additionally, the gas inlet velocity for the front burners and/or the first set of neat gas burners drags room air into the combustion chamber through the grate-covered combustion air openings due to the proximity of the gas feed lines for those burners to the openings.

The stove assembly preferably has a double wall construction such that an air chamber is defined by the outer walls of the stove housing and the walls of the combustion chamber, which air chamber partially or substantially surrounds the combustion chamber, as desired. In a preferred embodiment, the air chamber surrounds the combustion chamber on the top, rear and sides thereof. The stove housing has a louvered room-air inlet opening in the front surface thereof below the grate-covered combustion air openings through which room air is drawn by a suitable blower. The room air is forced through a channel to the rear of the stove assembly into the air chamber where it circulates about the heat exchanger therein. As stated, the heat exchanger communicates with the combustion chamber and the combustion gases pass therethrough prior to discharge through a flue. After being heated by the combustion gases, the room air is passed along the top or sides of the combustion chamber in the adjacent air chamber and discharged into the room via air outlets in the front of the stove housing.

It has been determined that operating the stove assembly of the present invention using the log assembly described hereinabove may result in the extinguishment of the flames issuing from the second neat gas burners positioned between the second and third logs. The reason for this is that during the early stages of operation, when the flue is cold, there is insufficient updraft to draw the combustion by-products from the combustion chamber and therefore those by-products tend to fill the combustion chamber and extinguish the flames.

This problem has been advantageously solved by lowering the second neat gas burners to a position closer to the base plate, providing a plurality of openings through the base plate in the vicinity of the second neat gas burners between the second and third logs, and providing an air channel in the stove assembly which communicates with the openings in the base plate to supply combustion air directly to the second neat gas burners and prevent extinguishment thereof. Preferably, the channel passes along the underside of the bottom wall of the combustion chambers from the front wall of the stove housing to a point below the foraminous portion of the base plate, whereat there is an opening in the bottom wall of the combustion chamber which allows the combustion air to enter the combustion chamber from the channel.

Further features and advantages of the present invention will become more apparent with reference to the accompanying drawings and the detailed description.

BRIEF DESCRIPTION OF THE DRAWINGS

FIG. 1 is a perspective of a preferred embodiment of the fireplace assembly of this invention, with the logs partially broken away.

FIG. 2 is a vertical cross-section from front to back of the fireplace assembly of the present invention taken on line 2—2 of FIG. 1.

DETAILED DESCRIPTION OF THE PREFERRED EMBODIMENTS

Figure 3:
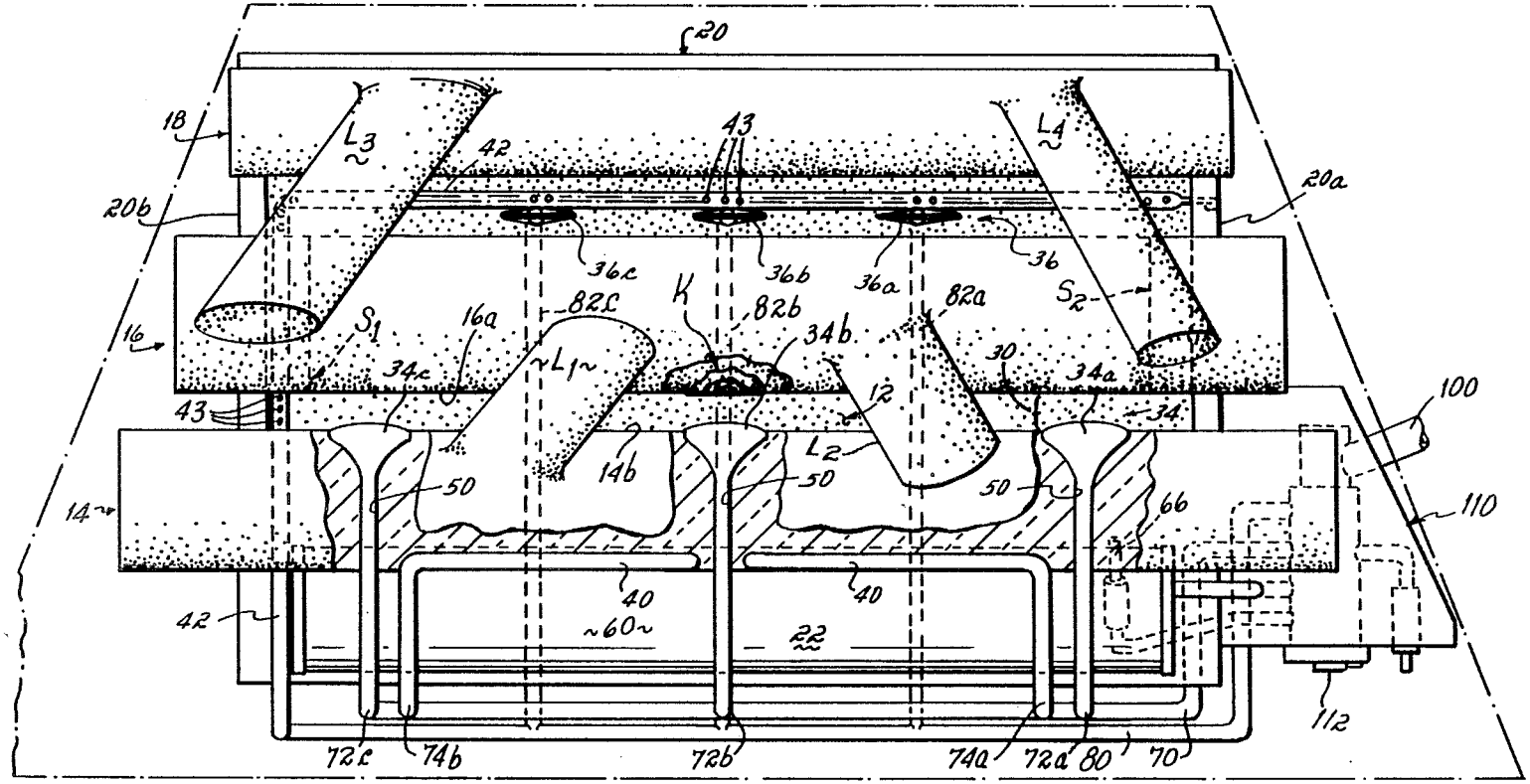
FIG. 3 is a top plan view, partially broken away, of the fireplace assembly of FIG. 1.

In a preferred form, and with reference to FIGS. 1 and 2, the fireplace assembly of the present invention includes a rectangular base plate 12, a first or front log 14, a second or intermediate log 16, and third or rear log 18. Base plate 12 and logs 14, 16 and 18 are supported by support structure 20, which has vertical side plates **20*a* and 20*b*. Vertical side plates 20*a* and 20*b* each have a plurality of notches 96 in their upper edge each of which conforms to the log which it supports. That is, rear notches 96*a* conform substantially to the shape of rear log 18, middle notches 96*b* conform substantially to the shape of middle log 16, and front notches 96*c* conform substantially to the shape of front log 14. Each log 14, 16 and 18 is supported adjacent its opposite ends by vertical side plates 20*a* and 20*b*, respectively, as shown in FIG. 3**.

In a preferred form, base plate 12 has a generally planar top surface **12*a*, and front log 14 has generally planar bottom and rear surfaces 14*a* and 14*b*, respectively. The base plate 12 is disposed at a slight angle relative to the horizontal plane so as to position the top surface 16*c* of the second log 16 at a higher vertical level than the top surface 14*c* of the front log 14. The angle is preferably between about 5° and 20°, and optimally is about 12°. Bottom surface 14*a* of front log 14 and top surface 12*a* of base plate 12 converge in the direction of second log 16 such that the distance between those surfaces is approximately 1.25" at a point adjacent front surface 14*d* of front log 14 and is about 1" at a point adjacent rear surface 14*b* of front log 14. Second log 16 is supported by support structure 20 such that its bottom surface 16*b* lies proximal top surface 12*a* of base plate 12 and its front surface 16*a* is spaced apart from rear surface 14*b* of front log 14** a distance of between approximately 0.5" and 1.5.", with the distance preferably being approximately 0.8". It should be appreciated that the optimal distances between the logs and base plate of the fireplace assembly will vary depending on the gas flow rate and gas pressure. The above distances are for a gas flow rate of about 22 $ft^3$/hr, and a gas pressure of about 4" $H_2O$ (gauge).

Bottom surface **14*a* of front log 14, top surface 12*a* of base plate 12 and side walls 20*a* and 20*b* of support structure 20 define a first elongated horizontal chamber section 28. Rear surface 14*b* of front log 14, front surface 16*a* of second log 16, top surface 12*a* of base plate 12, and side walls 20*a* and 20*b* of support structure 20 define a second elongated vertical chamber section 30. First and second elongated chamber sections 28 and 30 form an elongated heat chamber 32, which has an angled or substantially L-shaped cross-section, as best shown in FIG. 2. Optimally, the logs are positioned relative to each other and base plate 12 so as to maximize combustion and heat retention in elongated heat chamber 32 and minimize the production of undesirable by-products. The distances between the logs and the base plate, therefore, are an important aspect of the invention. If front and second logs, 14 and 16, respectively, are spaced too close together, combustion is poor due to lack of air in heat chamber 32. If front log 14 and second log 16 are spaced too far apart, heat chamber 32 will not capture the heat from the main burner flame. This is undesirable because heat chamber 32 will be too cool to radiate substantial heat to the surroundings and combustion of the first neat gas burner flames will not be enhanced and thus soot and carbon monoxide production will not be minimized. Side support walls 20*a* and 20*b* contain heat within chamber 32** that would otherwise escape therefrom were these walls not present.

Fireplace assembly 10 further includes main burner 22 which produces hot "blue" flames that project into heat chamber 32. Main burner 22 consists of an elongated tubular member 60 which extends substantially the width of the base plate 12. Main burner 22 is supported by support structure 20 in front of and below front log 14. Tubular member 60 of main burner 22 has a plurality of gas orifices 62 spaced along substantially the entire length of rear surface 64 thereof. Pilot 66 lights main burner 22 when gas is supplied thereto and flame jets issue from orifices 62 in rear surface 64 of tubular member 60 generally rearwardly into first elongated chamber section 28. The heat from the flames of the main burner 22 and the combustion products thereof, which are at a temperature in the range of approximately 1470° F. to 2030° F., is captured in heat chamber 32 and cause base plate 12, bottom and rear surfaces **14*a* and 14*b* of front log 14 and front surface 16*a* of second log 26 to glow visibly, simulating the glow of burning logs and embers. In addition, the heat from main burner 22 is radiated to provide heat to the surroundings. Main burner 22 also has two rows of flame ports or orifices 68 in the upper surface of tubular member 60. Small flames issue from flame ports 68 when main burner 22** is lit.

In addition to main burner 22, fireplace assembly 10 includes first neat gas burner assembly or means 34, which consists of three neat gas burner nozzles **34*a*–34*c* that pass through apertures 50 in front log 14 and which project rearwardly and upwardly from rear surface 14*b* of front log 14. The three neat gas burner nozzles 34*a*–34*c* communicate with first gas line 70 by neat gas burner supply branches 72*a*–72*c*. The three neat gas burner branches 72*a*–72*c* each pass through a respective aperture 50 in front log 14. The combustion of the gas issuing from the nozzles 34*a*–34*c* of the first neat gas burners 34 is enhanced by the substantial heat captured in heat chamber 32**.

Fireplace assembly 10 further includes dual front burners 40 which communicate with first gas line 70 by front burner supply branches **74*a* and 74*b*. Front burners 40, which are generally tubular, have a plurality of flame ports or apertures 41 in the front surface thereof for issuing flames outwardly from front surface 14*d* of front log 14. Front burners 40 are located proximal front surface 14*d* of front log 14 or, preferably, are embedded therein, such that apertures 41 remain visible. When gas is supplied to front burners 40 through front burner supply branches 74*a* and 74*b*, the flames issuing from flame ports 68 in main burner 22 ignite the gas issuing from front burners 40. The flames issuing from front burners 40 can be varied from visible yellow flames for aesthetics to hot "blue" flames which cause front surface 14*d* of front log 14 to glow. The flames are varied by adjusting the gas/air ratio which is supplied to the front burners 40. This can be accomplished by any suitable means, for example, by including air ports in front burner supply branches 74*a* and 74*b***, which can be opened or closed to increase or decrease the amount of air in the gas/air mixture.

The preferred embodiment further includes third log 18, which is supported by support structure 20 and is spaced rearwardly from second log 16 a distance of between approximately 1"–1.5". Disposed between second and third logs 16 and 18 are second neat gas burner assembly or means 36, which consists of three burner nozzles **36*a*–36*c*. Gas is supplied to burner nozzles 36*a*–36*c* of second neat gas burner assembly 36 from second gas line 80 by means of branch supply lines 82*a*–82*c*. Branch supply lines 82*a*–82*c* pass rearwardly from supply line 80 underneath base plate 12 and project upwardly through apertures 90 in base plate 12 to supply second neat gas burners 36*a*–36*c*. Also in communication with second gas line 80 is lighting tube 42, which extends rearwardly from second gas supply line 80 along side wall 20*b* to a point between second and third logs, 16 and 18, whereupon it makes a 90° bend and then extends substantially the width of the base plate 12 from side support 20*b* to 20*a* where it terminates. Lighting tube 42 has a plurality of apertures 43 in its upper surface from which gas issues. The flame from main burner 22 ignites lighting tube 42 when it is supplied with gas, and lighting tube 42 in turn ignites the second neat gas burners 36*a*–36*c*. Because the gas supply to lighting tube 42 and burners 36*a*–36*c* are independent, the gas/air mixture supplied to burners 36*a*–36*c* is variable and those burners may produce yellow flames for aesthetics or "blue" flames for additional heating. Preferably, a yellow flame is desired. Any suitable means may be included for adjusting the flames from burners 36*a*–36*c*;. for example, branch supply lines 82*a*–82*c* may have air ports which can be opened or closed incremently to change the gas/air ratio fed to the burners 36*a*–36*c***.

In all embodiments of the present invention there is included a gas flow regulator 110 for controlling the gas supply to fireplace assembly 10. In a preferred embodiment of the invention which includes front, second and third logs 14, 16 and 18, main burner 22, front burner 40, and first and second neat gas burners 34 and 36, gas flow regulator 110, which is connected to main gas supply line 100, has a control knob 112 with five operational settings. In a first setting, the off position, no gas flows to the fireplace assembly 10 and it is non-operational. In a second setting, gas flows from supply line 100 through regulator 110 to pilot 66, which is ignited in any suitable manner, for example, by an automatic spark igniter, or manually with a match. When the control knob 112 is turned to the third setting, gas flows through regulator 110 to main burner 22 and is ignited by pilot 66. With the control knob 112 in the fourth operational setting, gas flows to the front burners 40 and to first neat gas burners **34*a*–34*c*, all of which are positively ignited by the flames from main burner 22. When control knob 112 is in the fifth setting, the full-on position, gas is supplied to the second neat gas burners 36 and to lighting tube 42, which is lit by main burner 22 and which in turns lights second neat gas burners 36*a*–36*c***. With this type of control, variations in aesthetics and heat output from the fireplace assembly are possible by changing the setting to have more or less burners in operation at any given time.

In the preferred embodiment, branch logs $L_1$ and $L_2$ which span the front and middle logs 14, 16 are provided to restrict the escape of products of combustion from between the logs. This increases the heat trapped between the logs, in turn increasing the combustion efficiency and temperature on the confronting surfaces of the logs, causing the logs to visibly glow in a more enhanced fashion, which maximizes the realism of the log fire and the space heat provided to the environment.

Branch logs $L_3$ and $L_4$ which span across the tops of logs 16 and 18 are provided for decorative purposes only.

Transverse slots $S_1$ and $S_2$ disposed in the bottom surface **16*b* of the middle log 16 allow gaseous products of combustion to escape from the combustion chamber 32 to the lower portion of the space between the rear of the second log 16 and the front of the third log 18, whereupon they escape upwardly from between the second and third logs 16 and 18**.

A knot K is formed in the front surface **16*a* of middle log 16 and has a generally planar front surface K' which projects slightly forwardly and upwardly into the combustion chamber section 30 between logs 14 and 16**. The knot is heated to a visible red glow and radiates heat to the surrounding space.

Figure 4:
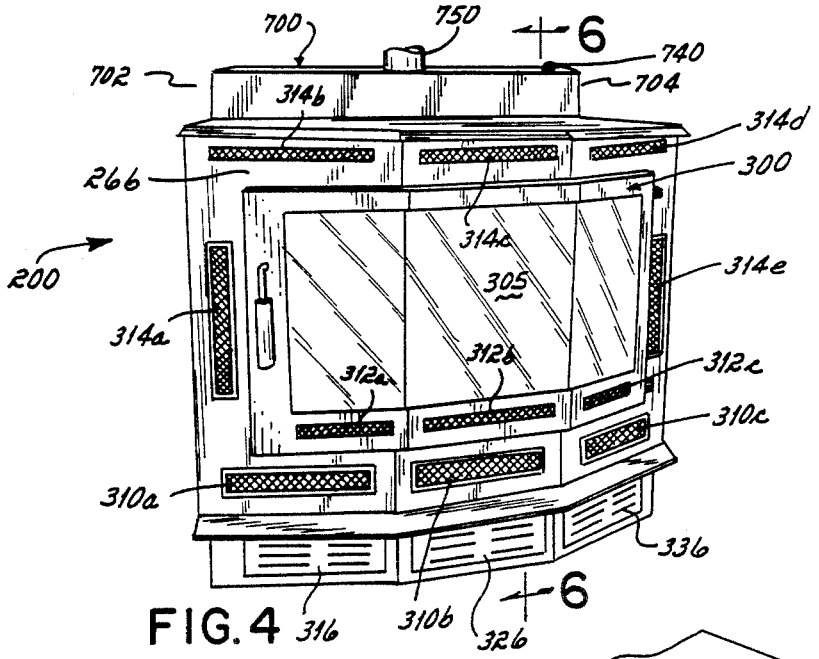
FIG. 4 is a front perspective of a preferred embodiment of the stove assembly of the alternative embodiment of the invention.
Figure 5:
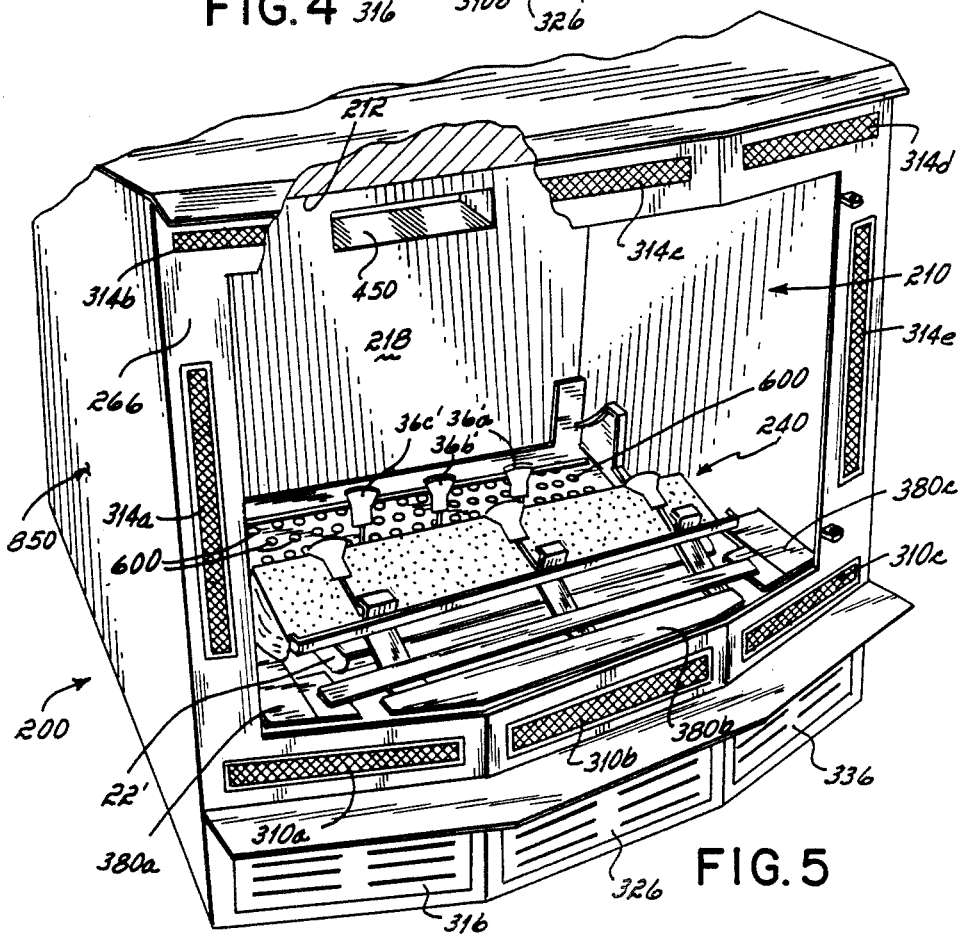
FIG. 5 is a perspective of the stove assembly shown in FIG. 4, partially broken away, with the front door removed to show the interior of the combustion chamber and the artificial logs partially removed.
Figure 6:
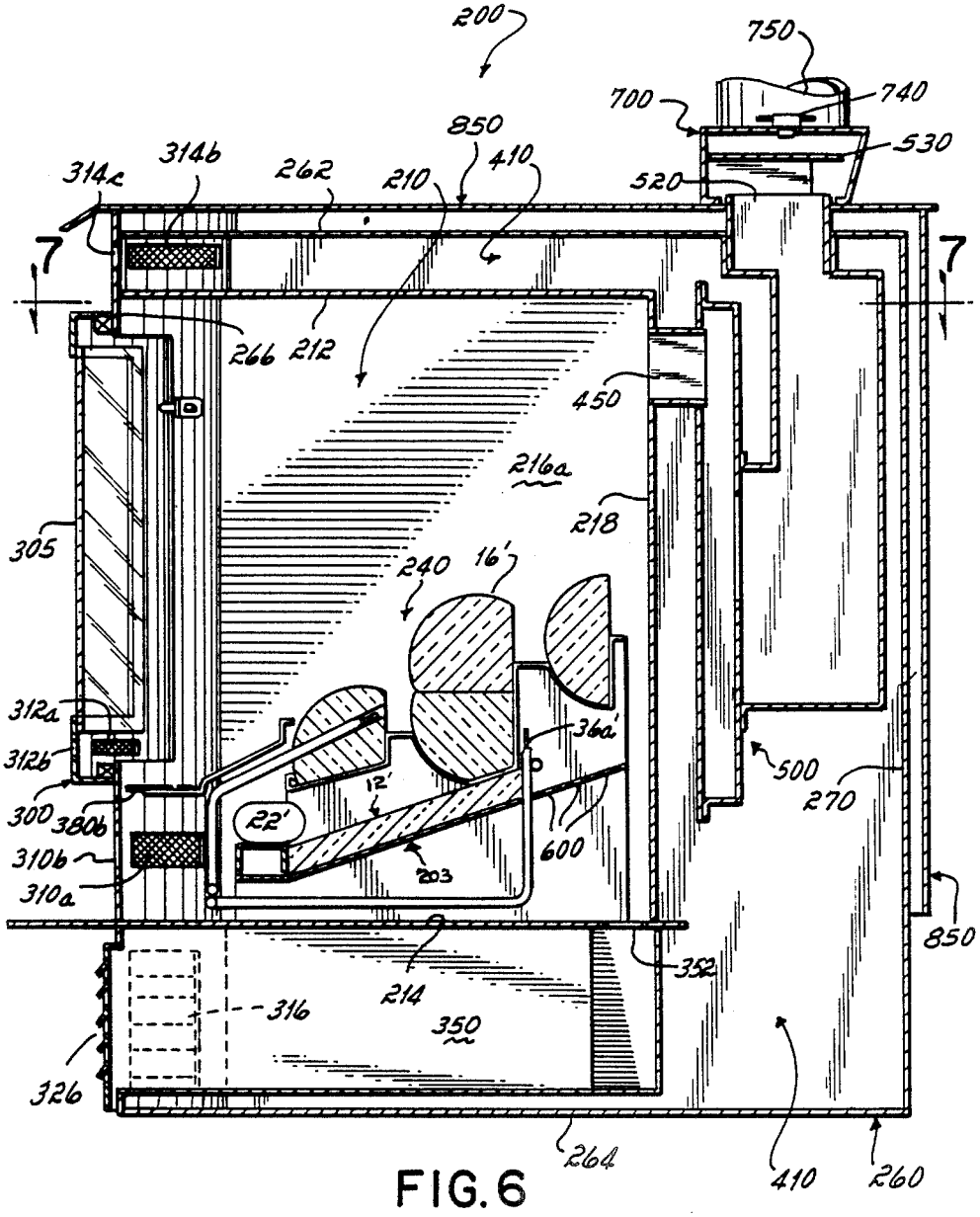
FIG. 6 is a vertical cross-section from front to back of the stove assembly of the present invention taken on line 6—6 of FIG. 4.
Figure 7:
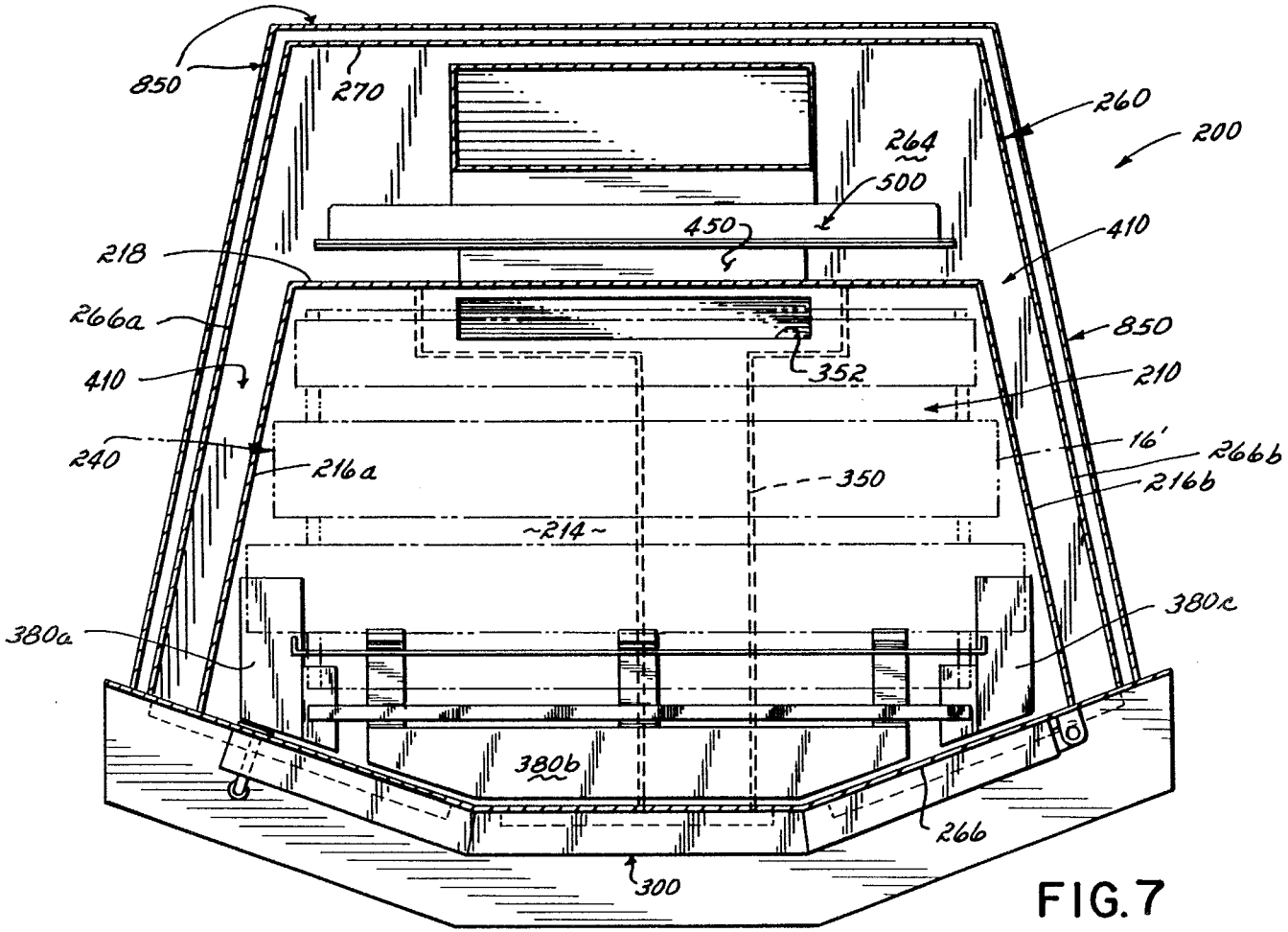
FIG. 7 is a top plan view, in partial phantom, of the stove assembly taken on line 7—7 of FIG. 6.

In an alternative embodiment, the present invention is directed to a gas-fired artificial log stove assembly 200 shown in FIGS. 4–7. Stove assembly 200 includes combustion chamber 210 in which is disposed log assembly 240 (FIG. 6). With the exception of certain modifications, which will be described hereinafter in greater detail, log assembly 240 is identical to the fireplace assembly described hereinabove and that description should be referred to for particular details. Additionally, the artificial logs used in log assembly 240 may be identical to those described with respect to the fireplace assembly, or they may be composite logs such as are disclosed in co-pending U.S. patent application Ser. No. 443,109, filed Nov. 28, 1989, in the name of Ian Thow, entitled COMPOSITE ARTIFICIAL LOG. Log 16, shown in FIG. 6 is an example of such a composite log.

With reference to FIGS. 4–7, stove assembly 200 has a combustion chamber 210 defined by top, bottom, side and rear walls 212, 214, 216*a* and 216*b*, and 218, respectively, and door 300, and an air chamber 410 substantially surrounding combustion chamber 210 defined on its outer periphery by top, bottom, front, side and rear walls 262, 264, 266, 268*a* and 268*b*, and 270, respectively, and on its inner periphery by walls 212, 214, 216*a* and 216*b* and 218. The top, side and rear walls, 262, 268*a*., 268*b* and 270, of air chamber 410 are insulated from the room by a dead air space between inner walls 262, 268*a*, 268*b* and 270 and outer shell 850. This serves to eliminate hot exposed surfaces which may be dangerous if touched.

Front wall 266 of the stove outer housing 260 has a plurality of openings therein, as shown particularly in FIGS. 4 and 5. First, wall 266 has a plurality of grate-covered combustion air openings 310*a*, 310*b* and 310*c* located below and adjacent door 300. Door 300, which has transparent panels 305, preferably has additional grate-covered combustion air openings 312*a*, 312*b* and 312*c* therein. Both sets of combustion air openings, 310*a–c* and 312*a–c*, communicate with combustion chamber 210 to provide combustion air thereto. Second, front wall 266 has grate-covered heated air discharge openings 314*a–e* which communicate with air chamber 410 to discharge the heated room air to the surroundings. Finally, front wall 266 has louvered openings 316, 326 and 336.

Louvered opening 316 conceals a suitable fan or blower (not shown) which draws room air into air chamber 410. Louvered opening 326 conceals the entrance to channel 350, which extends rearwardly under combustion chamber 210 to a point where it communicates with combustion chamber 210 through opening 352 in bottom wall 214. Channel 350 supplies combustion air to second neat gas burners 36*a'–c'*. Louvered opening 336 conceals the gas control mechanism (not shown) for log assembly 240.

Log assembly 240 differs from the fireplace assembly described herein in connection with FIGS. 103 in at least one critical respect. Whereas base plate 12 in the fireplace assembly extends the entire depth of the assembly from below front log 14 to below rear log 18, base plate 12' in log assembly 240 extends only to a point that corresponds to the rear surface of second log 16'. Additionally, base plate 12' in log assembly 240 is supported by support plate 203. Support plate 203 extends the entire depth of log assembly 240 and in the area between the second and third logs, support plate 203 is provided with a plurality of apertures 600, which allow the combustion air entering combustion chamber 210 through channel 350 to supply second neat gas burners 36*a'–c'*. Furthermore, second neat gas burners 36*a'–c'* and lighting tube 42, are positioned lower relative to support plate 203 than burners 36*a–c* in the fireplace assembly. The reason for lowering the burners 36*a'–c'* in the stove assembly is to increase the supply of combustion air by placing the burners closer to the source of that air, i.e., channel 350 and apertures 600 in bottom wall 214, thereby preventing extinguishment of the flames from the burners by products of combustion which tend to accumulate when the stove is initially ignited and the flue has not yet warmed up to create an updraft for transporting products of combustion from the combustion chamber.

In a preferred embodiment, bottom wall 214 of combustion chamber 210 extends outwardly from front wall 266 at a point between combustion air openings 10*a–c* and louvered openings 316, 326 and 336, so as to prevent disruption of the flow of combustion air into combustion chamber 210 by the room air entering channel 350 and being drawn into air chamber 410 by the fan (not shown). Additionally, log assembly 240 includes plates 380*a–c*, which are positioned immediately adjacent front wall 266, inside combustion chamber 210, in a plane slightly above combustion air openings 310*a–c*, to contain and direct the combustion air in the vicinity of the front burners and main burner 22'. Plates 380*a–c* also serve to prevent the combustion by-products which fill combustion chamber 210 from extinguishing the flames issuing from those burners.

Combustion chamber 210 has an outlet opening 450 in rear wall 218 thereof for releasing the combustion by-products into heat exchanger 500. As the hot combustion by-products pass through heat exchanger 500, room air is circulated through air chamber 410, in which heat exchanger 500 is disposed, to heat the room air prior to its discharge through heated air discharge openings 314*a–e*. The combustion by-products then pass from heat exchanger 500, through down-draft diverter 700, and out through a suitable flue (designated generally as 750).

Down-draft diverter 700 communicates with heat exchanger 500 through opening 520. Directly above opening 520 in diverter 700 is baffle 530, which lies in a direct path between opening 520 and flue 750. Additionally, the opposite ends 702 and 704 of diverter 700 are open to the room. Baffle 530 serves to deflect or divert any sudden down-draft of air from flue 750 out open ends 702 and 704 of diverter 700, thereby preventing combustion by-products from being forced backed into combustion chamber 210 and potentially disrupting or extinguishing the flames.

Diverter 700 additionally includes a thermocouple 740 (or any other suitable means appreciated by persons skilled in the art) adjacent either open end 702 or 704, which is connected to the gas supply regulator and which is used to detect an increase in temperature in the diverter and automatically shut off the gas supply to the stove assembly once a preselected temperature limit has been reached. If the flue is not open or becomes blocked during use of the stove, hot combustion by-products will become backed-up in the diverter, thus raising the temperature thereof. When the preselected temperature limit is detected by the thermocouple, the stove is shut off. Thus, the thermocouple acts as a safety shut-off for the stove apparatus.

The present invention thus provides a gas-fired artificial log stove assembly having horizontally disposed logs which can be operated to provide substantial heat to the surroundings by heating room air by circulating it around a heat exchanger containing hot combustion by-products while at the same time providing a very realistic, aesthetically pleasing fire which glows and flickers like a traditional fire. Particular variations in the arrangement and elements of the gas stove assembly of this invention will be obvious to those skilled in the art. The scope of this invention is defined by the appended claims and is not meant to be limited by the various examples herein.

What is claimed:

1. A gas-fired stove assembly comprising:

a combustion chamber defined by top, bottom, side, front and rear walls, said front wall having an opening therein;

door means for covering said opening in said front wall;

an air heating chamber partially surrounding said combustion chamber through which room air is circulated for heating room air; and an artificial log assembly disposed in said combustion chamber for providing an aesthetically pleasing fire, said log assembly comprising:

a support structure;

a base plate of a refractory material that glows visibly above approximately 1470° F., said base plate having a generally planar upper surface and being supported by said support structure;

a front artificial log having front, rear, top and bottom surfaces, said front log being supported by said support structure such that said bottom surface of said front log is spaced above said base plate to define a first elongated generally horizontal chamber section;

a second artificial log having front, rear, top and bottom surfaces, said second log being supported by said support structure such that said bottom surface of said second log is proximal said base plate and said front surface of said second log is spaced from said rear surface of said front log to define a second elongated generally vertical chamber section, said first and second chamber sections collectively defining an elongated heat chamber having an angled cross-section;

a third artificial log having front, rear, top and bottom surfaces disposed generally horizontally and parallel to said front and second logs, said third log being being supported by said support structure such that said front surface of said third log is spaced inwardly from said rear surface of said second log a distance of between approximately 1" and 1.5";

second neat gas burner means for issuing flame jets generally upwardly between said second and third logs to enhance the realism of the fireplace assembly;

a combustion air inlet channel which communicates with said combustion chamber at a point adjacent said second neat gas burner means to enhance combustion and prevent extinguishment of the flames issuing therefrom;

said logs disposed generally horizontally and parallel to each other and to the plane of said front wall of said combustion chamber; and gas burner means supported by said support structure extending along and in front of said front log for directing blue flame jets into said first elongated chamber section toward said second log for heating to a visible glow said bottom and rear surfaces of said front log, said front surface of said second log, and said base plate, whereby substantial heat is radiated and an appearance of glowing logs and underlying embers is provided to enhance the aesthetics of the artificial log stove.

2. The stove assembly as recited in claim 1 wherein the spacing between said bottom surface of said front log and said base plate is approximately 1", and the spacing between said front surface of said second log and said rear surface of said front log is in the approximate range of 0.5"–1.5".

3. The stove assembly as recited in claim 1 wherein said bottom and rear surfaces of said front log are generally planar so as to trap heat in said elongated heat chamber for higher radiant efficiency and higher combustion efficiency.

4. The stove assembly as recited in claim 1, further comprising blower means associated with said air heating chamber for drawing room air into said air heating chamber, circulating the air in said chamber, and discharging the heated air back into the room.

5. The stove assembly as recited in claim 1, further comprising:

first neat gas burner means for issuing flame jets directed upwardly and rearwardly toward said front surface of said second log to enhance the realism of the fireplace assembly, whereby the radiant heat from said elongated heat chamber enhances the combustion efficiency of the gas from said neat gas burners.

* * * * *

UNITED STATES PATENT AND TRADEMARK OFFICE

CERTIFICATE OF CORRECTION

PATENT NO. : 4,971,030

DATED : November 20, 1990

INVENTOR(S) : Thow et al.

It is certified that error appears in the above-identified patent and that said Letters Patent is hereby corrected as shown below:

Column 6, line 67, "26" should be --16--

Column 9, line 6, "16" should be --16'--

Column 9, line 17, "268a.," should be --268a,--

Signed and Sealed this

Eighth Day of September, 1992

*Attest:*

DOUGLAS B. COMER

*Attesting Officer*

*Acting Commissioner of Patents and Trademarks*